United States Patent [19]

Cloup

[11] 4,040,320

[45] Aug. 9, 1977

[54] PUNCHING MACHINES

[76] Inventor: Jean Cloup, 33360, Latresne, France

[21] Appl. No.: 631,158

[22] Filed: Nov. 11, 1975

[30] Foreign Application Priority Data

Dec. 26, 1974 France ..... 74.42895

[51] Int. Cl.[2] ..... B26D 5/02

[52] U.S. Cl. ..... 83/527; 83/560; 83/563; 83/685; 83/368

[58] Field of Search ..... 83/559, 560, 563, 685, 83/527, 368

[56] References Cited

U.S. PATENT DOCUMENTS

| | | | |
|---|---|---|---|
| 1,175,198 | 3/1916 | Thomas | 83/560 X |
| 3,805,659 | 4/1974 | Fisher, Jr. | 83/560 |
| 3,858,471 | 1/1975 | Valente | 83/560 X |
| 3,892,154 | 7/1975 | Duffy | 83/560 X |

*Primary Examiner*—Willie G. Abercrombie

*Attorney, Agent, or Firm*—Marn & Jangarathis

[57] ABSTRACT

A punching machine for use in punching holes in the sides of articles incorporating two C-shaped assemblies forming punching tool supports and guided within the machine in such a way that they can be displaced and moved away from each other. Means are provided for placing the assemblies, on the one hand, in a working position, in which the position of a punch tool on one of the tool supports is maintained at a predetermined distance from a guide plane coinciding with a guiding surface on the article to be drilled, and in which the spacing of the tool supports is maintained at a predetermined value, and on the other hand, in a position for rotation of the article to be drilled, such that each assembly is displaced in relation to its working position in the sense of an increase in the distance separating the two assemblies.

7 Claims, 2 Drawing Figures

PUNCHING MACHINES

Figure 1:
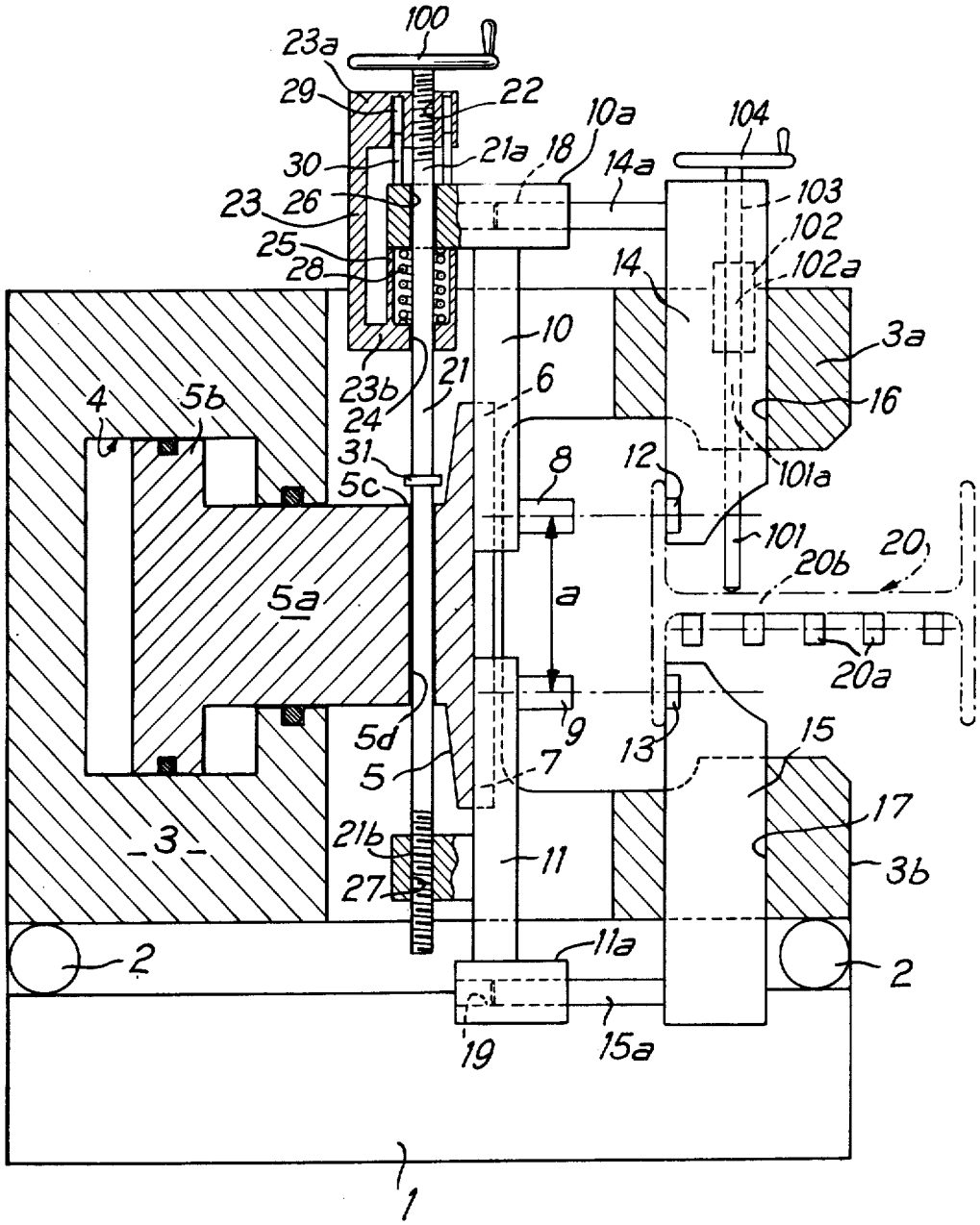

The present invention concerns a punching machine used particularly for punching holes in the sides of shapes, of a type comprising two assemblies carried by a frame and each forming a general C-shape, juxtaposed and disposed symmetrically in relation to each other, each assembly comprising, on one of its arms, a punching tool support, and means provided for controlling the forward movement of each punch tool as well as means provided for regulating and maintaining the said assemblies in the working position, with a predetermined spacing of the tools. In the present text, the term "to bore" or "to punch" means a complete operation for making a hole through a solid.

In a known boring machine of this type, assemblies in a C-shape, known as auxiliaries, are provided, which are fixed at an adjustable distance from each other, on the fixed frame of the machine. The inner arm of each of the C-shaped auxiliary parts comprises a punch, whilst the corresponding die holder is mounted axially and slides onto the other arm of the said C-shaped part. Each of the auxiliary C-shaped parts is fixed to a corresponding fixed C-shaped assembly forming part of the fixed part of the press, the two die holders being attached to a mobile platform of this single press. This known machine is of a complicated construction because of the presence of auxiliary C-shaped parts adjustably fixed on the fixed C-shaped assemblies of the frame. Furthermore, this known machine is difficult to use because, every time the number of dies is changed, disassembly and reassembly of the auxiliary parts is necessary. Besides, in this known machine, the fixed C-shaped assemblies are spaced at a fixed distance from each other corresponding to the minimum spacing of the holes to be bored, with the result that, when this machine is intended for the punching of shapes of narrow width, this distance should be very narrow, and makes the rotation of the shapes difficult at the time of positioning for punching of the shapes.

It is an object of this invention to provide a punching machine of a simple construction permitting free rotation of the shape to be punched.

Accordingly, in the machine of the type mentioned above, the invention provides that the two assemblies are guided within the machine in such a way that they can be displaced and moved further from each other, and in which means for controlling positioning are provided to place and maintain the said assemblies, on the one hand, in the working position, in which the position of one of the punch tools is maintained at a predetermined distance from a guide plane coinciding with a guiding surface on the shape to be drilled, and in which the spacing of the tools is maintained at a predetermined value, and on the other hand, in a position for rotation of the shape to be drilled, such that each assembly is displaced in relation to its working position in the sense of an increase in the distance separating the two assemblies.

Thus this new machine permits simple regulation of the drilling.

Figure 2:
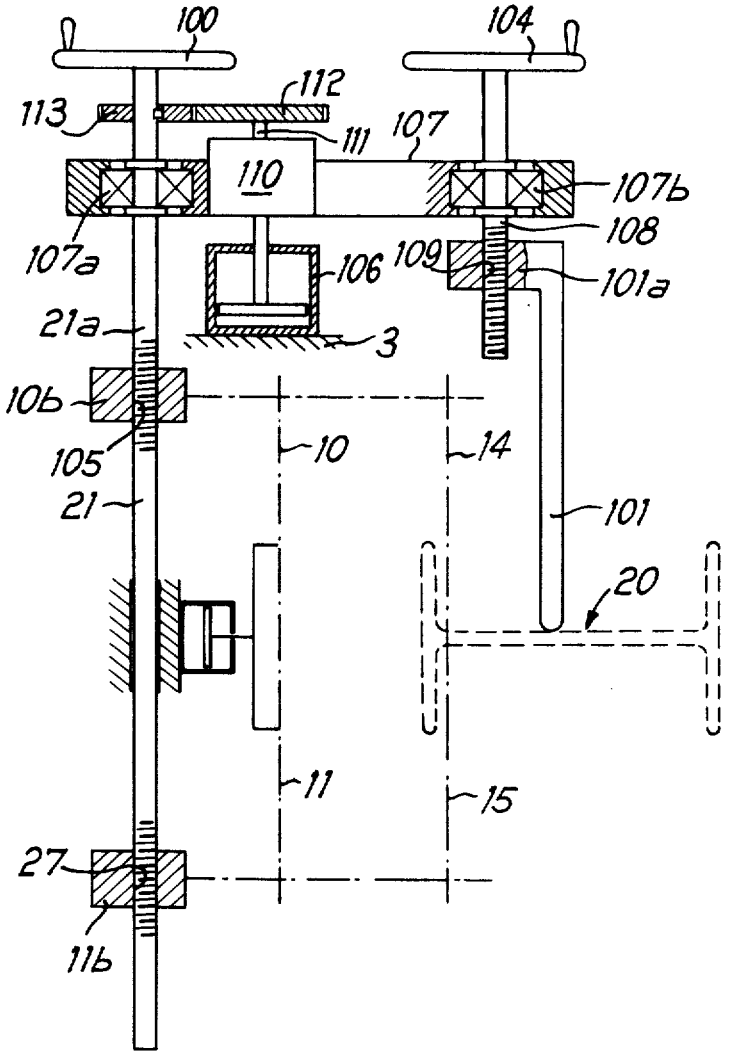

The invention may be performed in various ways, and two embodiments thereof will now be described with reference to the accompanying drawings, in which:

FIG. 1 is an elevational view in cross-section of a punching machine according to the invention, and FIG. 2 is a schematic view of another method of construction.

In FIG. 1, a punching machine with two punches is illustrated, comprising a lower fixed frame or bench 1 on which a press frame 3 is mounted, for horizontal sliding, via wheels 2. In the frame 3 is arranged a bore with a horizontal transverse axis 4, in which a piston **5*b*, formed by the rear end of an element 5*a* integral with a platform of a single press 5, slides axially and in an airtight manner. The interior volume of the bore 4 can be connected to a source of fluid under pressure (not shown), with the result that the bore 4 together with the piston 5*b*, effectively forms the pressure screw-jack of the press of the machine. On the front surface of the press platform 5 are arranged two rectilinear guides 6, 7 which, in the example shown, are each constituted by an extreme part of a single vertical dovetail groove. Each punch 8, 9 is mounted on a corresponding punch holder 10, 11 which is itself mounted slidably on a respective guide 6, 7 of the platform 5. Each of two dies 12, 13 is mounted at the end of a corresponding die holder 14, 15 which is mounted slidably along a vertical axis parallel to the groove 6, 7 on a respective support arm 3*a*, 3*b* of the frame of the press 3. According to the example shown, each support 14, 15 is mounted slidably in a bore 16, 17 of the respective arm 3*a*, 3*b* the two bores 16 and 17 being coaxial. Each die holder 14, 15 presents an elongated element 14*a*, 15*a* on an axis perpendicular to that of the bores 16 and 17; each element 14*a*, 15*a* is respectively engaged to slide axially without play in a bore 18, 19 arranged in an end portion 10*a*, 11*a* of the respective punch holder 10, 11. The guide means 14*a*, 18, 10*a* and 15*a*, 19, 11*a* enable each die 12, 13 and the corresponding punch 8, 9** to have their centres held on the same axis.

A sensor 101 is mounted in the upper die support 14 and extends parallel to the sliding axis of the said die support 14 in the arm **3*a* of the frame 3. The sensor 101 which is guided axially within the block support 14, is screw-threaded at its upper end 101*a*. This end is screwed into an axial tapping 102*a* of a cylindrical portion 102 which is mounted rotatably in the block support 14 and which rotates integrally with a rod 103, the rotation of which is controlled by means of a steering wheel 104. Movement of the steering wheel 104 thus adjusts the axial position of the sensor 101 which will bear, at its free end, on the core 20*b* of a shape 20**.

Means are provided furthermore, to allow momentary separation of the die holders 14, 15 in order to facilitate the axial rotation and the placing in the punching position, of a shape such as the shape 20 represented in FIG. 1. This shape 20 is, for example, supported by a rolling guide on the horizontal axis of which only the rollers **20*a*** are shown on the Figure.

Means for regulating and maintaining the spacing of the guide means comprise a rod or screw 21 of which each end **21*a*, 21*b* is screw-threaded with a pitch opposite to that of the other end 21*b*, 21*a* respectively; a steering wheel 100 is mounted at the end of the upper end 21*a* of the screw 21; the end 21*a* is screwed into a tapping 22 formed in an end portion 23*a* of a part 23 of a U-shaped cross-section; the other end portion 23*b* of the part 23 presents a smooth bore 24 and a hollow cylinder 25 traversed axially by the screw 21. In its middle part, the screw 21 traverses, with little or no play, a smooth bore 5*b* of the element 5*a* of the platform of the press 5, with the result that this screw 21** is guided and movable axially in the movable platform of the press.

The end portion 10*a* of the upper punch holder 10 presents a smooth bore 26 traversed by the screw 21 and disposed between the hollow cylinder 25 and upper end portion 23*a* of the part 23.

The lower end 21*b* of the screw 21 is screwed into a tapping 27 housed in an extending portion 11*b* of the lower punch holder 11.

Thus, it is easily understood that it is possible to regulate precisely, the spacing *a* existing between the punch holders 10, 11 by operating the steering wheel 100, the centering of the punching axes being achieved by means of the sensor 101, whose depth is regulated by means of the steering wheel 104.

Furthermore, means are provided which permit a momentary separation and an automatic repositioning for punching of the punch holders 10, 11 and the die holders 14, 15. For this purpose, a spring 28 is disposed in the hollow cylinder 25 and rests, on the one hand, on the extreme inner face 23*b* of the part 23 and, on the other hand, on the portion 10*a* of the upper punch holder 10. In the upper end portion 23*a* of the piece 23 are housed several bores 29 in each of which slides a piston rod 30 in an airtight manner. Each bore 29 can be connected to a source of fluid under pressure (not shown). Furthermore, on the screw 21 is mounted, at a convenient position, an abutment 31 which can co-operate with a fixed abutment provided by the lateral surface 5*c* of the element 5*a* of the press platform 5.

Thus, when the positioning rams 29, 30 are not supplied with fluid, the spring 28 maintains the die supports 14, 15 at their maximum distance apart, allowing free rotation of the shape to be punched. In this free rotation condition of the shape 20, the assembly of the die supports 14, 15 and the punch supports 10 and 11, connected by their rod 21, no longer rest against the instrument 20*b* of the shape 20 by means of the sensor 101; this assembly rests against the element 5*a* of the press platform 5 by means of the abutment 31 which thus rests against the lateral surface 5*c*. In order to reposition the machine ready for work (as shown in FIG. 1) it is sufficient to feed the rams 29, 30 whose rods 30 drive back the part 10*a* against the spring 28, until this part 10*a* abuts the extreme free end of the hollow cylinder 25 which provides a movement stop.

FIG. 2 shows a second method of construction of the invention. In order to simplify the drawing, the press and the frame, whose construction can be the same as that of the press 4 - 7 and the frame 1 of the machine in FIG. 1, are basically not represented. Also, the die holders 14 and 15 and the punch supports 10 and 11, which are identical to the corresponding elements of the machine in FIG. 1, are shown by dotted lines. However, in the case of FIG. 2, the upper punch support 10 (like the lower punch support 11), is provided with a tapping 105, which is housed in an extending portion 10*b* and into which is screwed the part 21*a* of the rod 21.

The method of construction of FIG. 2 differs from that shown in FIG. 1 basically because the positioning of the assembly, enabling free rotation, that is to say, the raising of the sensor 101, is achieved in FIG. 2 by means of a motor such as a hydraulic piston 106, which rests on the press frame 3 and acts on a common support 107, in which rotate and are axially fixed, both the rod 21 and the screw-threaded rod 108, which allows regulation of the axial position of the sensor 101. Thus the rod 21 is mounted rotatably and maintained axially in a bearing 107*a* of the common support 107, whilst the rod 108 is mounted rotatably and maintained axially in a bearing 107*b* of the said support 107. The rod 108, rotatable integrally with the steering wheel 104, is screwed into a tapping 109 of an end portion 101*a* of the sensor 101. The numerical control means 110, integral with the support 107, can control regulation of the distance between the drilling axes and control the positioning from each other of the drilling assemblies 10, 14 and 11, 15. For this purpose, the numerical control means 110 presents an outlet shaft 111 onto which is keyed a cog 112 which engages with a cog 113 keyed to the rod 21.

The method of operation of the machines shown in FIGS. 1 and 2 will now be described. Firstly the assembly is placed in position for free rotation of the shape 20, and the said assembly of the punch supports and the die supports and the sensor is supported either on the press platform (as in FIG. 1) or on the frame of the press (as in FIG. 2). In this position, it is also possible to regulate the spacing *a* and the depth of the sensor 101, by means of the steering wheels 100 and 104 respectively. When the shape 20 is in the drilling position, the sensor 101 is lowered, so that it rests on the core 20*b* of the shape 20.

Clearly various modifications can be made by those skilled in the art to the arrangements or processes which have been described solely as non-limiting examples, whilst remaining within the scope of the invention.

I claim:

1. A punching machine for use in punching holes in the sides of a shape comprising:

a frame;

a press forming punch closing control means having a fixed portion integral with the frame of the machine and having a mobile platform;

two generally C-shaped assemblies including at least two arms carried by the frame juxtaposed and disposed symmetrically in relation to each other; each assembly comprising a first part which constitutes one arm of a C-shape assembly bearing a punching tool and which is mounted axially and slidably on said mobile platform of said press and a second part which constitutes the other arm of said C-shape assembly and which is mounted axially and slidably on the frame parallel to the sliding axis of the said first part;

connecting means provided to interconnect each of the said first parts to the corresponding second part;

means provided for controlling the forward movement of said punch tool;

means provided for regulating and maintaining said assemblies in a working position, with a predetermined spacing of said punch tools, said C-shape assemblies being guided within said machine in such a way that said C-shape assemblies can be displaced and moved further from each other; and means for controlling and positioning said C-shape assemblies, firstly, in a working position in which the position of one of said punch tools is maintained at a predetermined distance from a guide plane coinciding with a guiding surface on the shape to be punched and in which the spacing of the tools is maintained at a predetermined value, and secondly in a position to rotate the shape to be punched such that each of said C-shape assemblies is displaced in relation to its working position in the sense of an increase in the distance separating said assemblies.

2. The punching machine as defined by claim 1, wherein the means for controlling and positioning comprise space determining means to regulate, at a predetermined value, the separation of the two assemblies, zero regulating means comprising a sensor which is integral with a first one of the assemblies and through which that assembly can rest against the guiding surface of the shape to be punched when the assemblies are in the working position, and motor means which can displace each of the said assemblies from its working position by moving the one further from the other.

3. The punching machine as defined by claim 1, wherein the means for controlling positioning comprise spacing determining means to regulate, at a predetermined value, the separation of the two assemblies, zero regulating means comprising a sensor which is integral with a first one of the assemblies and through which that assembly can rest against the guiding surface of the shape to be punched, when the assemblies are in the working position, and motor means which can displace the first assembly, relative to the frame to move the sensor away from the shape to be punched.

4. The punching machine as defined by claim 2 wherein the motor means comprises a fixed motor interposed between the frame and the first assembly and which can displace the first assembly relative to the shape to be punched while resting on said frame.

5. The punching machine as defined by claim 2 wherein the motor means includes an arrangement for numerical control, and also includes means for regulating the spacing between the two assemblies.

6. The punching machine as defined by claim 2 wherein the means for regulating the spacing between the two assemblies comprises a rod having two ends, each of said end being screw-threaded on a pitch counter to that of the other end, and respective elements, integral with a corresponding assembly, into which each of said end is screwed.

7. The punching machine as defined by claim 3 wherein the means for regulating the spacing between the two assemblies comprises a rod having two ends, each of said end being screw-threaded on a pitch counter to that of the other end, and respective elements, integral with a corresponding assembly, into which each of said end is screwed.

* * * * *